United States Patent [19]

Dyar

[11] 4,377,927

[45] * Mar. 29, 1983

[54] PREFABRICATED THERMAL INSULATING SYSTEM FOR BUILDINGS

[76] Inventor: Harrison G. Dyar, P.O. Box 185, Tampa, Fla. 33601

[ * ] Notice: The portion of the term of this patent subsequent to Jun. 15, 1999, has been disclaimed.

[21] Appl. No.: 278,091

[22] Filed: Jun. 29, 1981

[51] Int. Cl.[3] ..... E04B 1/78

[52] U.S. Cl. ..... 52/407

[58] Field of Search ..... 52/577, 576, 404, 407, 52/406; 220/421, 420, 423, 445, 9 C

[56] References Cited

U.S. PATENT DOCUMENTS

| | | | |
|---|---|---|---|
| 698,453 | 4/1902 | DeClairmont | 52/302 |
| 1,239,770 | 9/1917 | Coleman | 52/577 |
| 1,337,611 | 4/1920 | Mendenhall | 220/420 |
| 1,833,633 | 11/1931 | Oddman | 220/420 |
| 2,119,438 | 5/1938 | O'Leary | 220/420 |
| 2,863,297 | 12/1958 | Johnston | 220/423 |
| 3,487,971 | 1/1970 | Kirgls | 220/423 |

FOREIGN PATENT DOCUMENTS

| | | | |
|---|---|---|---|
| 1043363 | 7/1955 | Fed. Rep. of Germany | 220/420 |

*Primary Examiner*—John E. Murtagh

*Attorney, Agent, or Firm*—Diller, Ramik & Wight

[57] ABSTRACT

This disclosure relates to a prefabricated insulating system for buildings including a plurality of hollow insulating inner panels each defining an interior chamber under negative pressure, the latter panels being of a predetermined external peripheral size and shape and being housed within an outer hollow panel of a predetermined internal and external peripheral size and shape with the inner panels being housed within the hollow outer panel in generally side-by-side relationship, and the outer panel having one or more openings therethrough which mate with existing door, window and like openings in an associated building structure whereby the system can be constructed at a factory in a prefabricated fashion to the mirror image of existing building structures, such as ceilings, floors, walls or like building elements, delivered to the building and installed in position for insulating purposes.

17 Claims, 7 Drawing Figures

PREFABRICATED THERMAL INSULATING SYSTEM FOR BUILDINGS

This application is directed to a prefabricated thermal insulating system of the type generally disclosed in applicant's copending patent application, Ser. No. 215,083 filed on Dec. 10, 1980, entitled A THERMAL INSULATING SYSTEM PARTICULARLY ADAPTED FOR BUILDING CONSTRUCTIONS, and now U.S. Pat. No. 4,334,395.

In the latter-identified Patent Application, the disclosure of which is incorporated hereat by reference, there is disclosed a hollow insulating panel which includes an interior chamber under negative (vacuum) pressure. The insulating panel or panels are utilized individually or in groups and are inserted in the load bearing elements (walls, floors and/or ceilings) of buildings for insulating purposes. Panels of the latter type are positioned in, for example, the areas or volumes between the studs of a building wall and a plurality of springs, chains or the like are utilized for supporting these panels in spaced relationship to the associated building structure (studs). The springs or like connectors contact the insulating panel only at limited exterior surface areas thereof and, thus, there is minimal thermal conduction between the individual insulating panels and the surrounding building structure (studs). Furthermore, a plurality of pin-like elements which might be conventional nails are positioned about the exterior of the insulating panels in spaced relationship thereto, and the purpose of this structure is to contact the insulating panels only at limited exterior surface areas should the springs, links, or the like become inoperative which in the absence of the nails would result in direct contact between the insulating panels and the associated building elements or structure (studs), thus reducing the efficiency of the insulating panels.

In keeping with the present invention, insulating panels of the type just described are utilized but instead of being individually positioned in the load bearing ceilings, walls, floors or like building elements, the same are preassembled in a preformed or prefabricated panel which is built at a factory or at a site remote from the building in which the composite panel is to be installed. Such composite panel includes a plurality of evacuated insulating panels under negative pressure of the type heretofore described, and additionally include one or more openings or access areas which correspond in size, shape and location to like openings in the existing load bearing walls, ceilings, floor or the like. For example, if a building which is to be constructed or has been constructed includes as one vertical wall a door and a window therein, the composite panel of this invention is constructed of a length and width corresponding to that of the building wall and is also provided with two openings corresponding in size, shape and location to the door and window opening of the load bearing wall of the building which is to be built or has been built. Thus, when the composite panel with its insulating panels housed therein is shipped to the site, it can be readily placed within the building and, of course, positioned with its openings aligned with the pre-existing openings of the load bearing vertical wall.

Obviously, if a building has been completely built and is under roof, it is generally impossible without adversely affecting its structure to form a composite wall, ceiling or floor corresponding in total length and width to an existing wall, ceiling or floor, simply because it would be impossible to place the composite insulating panel within the existing building. In such cases, a composite insulating panel is formed of a variety of different lengths and of widths which are no greater than the standard height of a single door opening (approximately 7 feet). Thus, if a floor measuring 14 by 20 feet were to be covered by one or more composite panels in accordance with this invention which necessarily had to be moved into position through a standard door opening, two such composite panels measuring generally 7 feet by 10 feet could be utilized, would pass through a conventional door opening, and would in side-by-side relationship cover the entire 14 feet by 20 feet floor. Obviously, a lesser number of such composite panels might be utilized as, for example, four composite panels each measuring 7 feet by 10 feet which would be readily and conveniently handled because of the lesser size and corresponding weight.

In existing buildings in which the vertical walls are to be insulated by composite insulating panels in accordance with this invention, the composite panels are preformed in the most convenient units possible to minimize the number of composite units or panels per wall and, of course, permit the ease of introduction thereof through existing building openings (doors and windows) for insulating purposes. A vertical wall of an existing building may have, for example, a door and a window of standard size and depending upon the positioning of either relative to each other and to the overall periphery of the existing building wall, two, three, four or more composite panels might be utilized, as will be described more fully hereinafter. However, in all cases, the invention is directed to the construction of the composite panel as a preformed unit for assembly interiorly of a built or to be built building, although the same units might, of course, be applied to the exterior of such existing or to be built buildings and, of course, appropriate siding applied thereupon.

In keeping with this invention, the system or composite insulating panel includes one or more hollow insulating inner panels within an outer hollow panel of a predetermined internal and external peripherl size and shape, and depending upon the particular building which is to be insulated, the outer hollow panel may be devoid of any openings or may have one or more openings therein to accommodate existing door openings, window openings, stairwell openings, drain and sewer pipe openings, etc.

In further accordance with this invention, such composite panels are prefabricated in manageable units for delivery to and assembly at an onsite location for insulating buildings which are under construction or which have already been constructed.

With the above and other objects in view that will hereinafter appear, the nature of the invention will be more clearly understood by reference to the following detailed description, dependent claims and the several views illustrated in the accompanying drawings.

IN THE DRAWINGS

Figure 1:
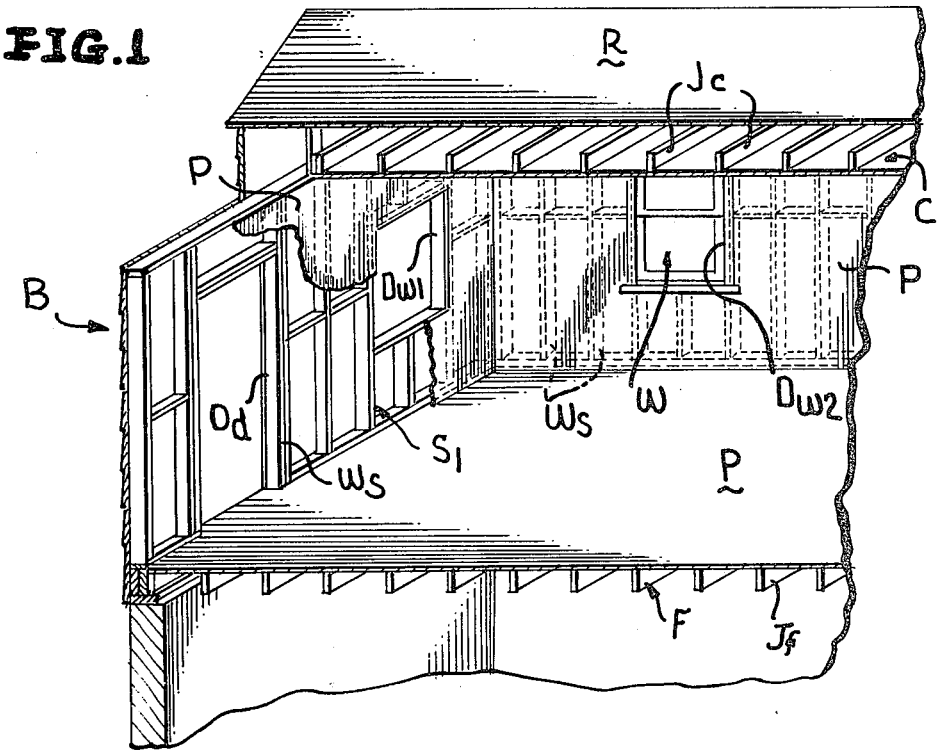
FIG. 1 is a fragmentary perspective view of a conventional uninsulated building illustrating a plurality of vertical walls, a ceiling, a floor, and conventionally disposed window and door openings.

Reference is first made to FIG. 1 of the drawings which illustrates a conventional building which is generally designated by the reference numeral B and includes a roof R beneath which is a conventional ceiling C, sidewalls S1, S2, and a conventional floor F. The ceiling includes conventional ceiling joist Jc while the floor F includes conventional floor joist Jf. The side walls S1, S2 include vertical wall studs Ws which in part define conventional door openings Od, and the window openings Ow1 and Ow2, the latter of which includes therein a conventional window W. The ceiling C, side walls S1 and S2, and floor W also include conventional panelling, sheeting, sheet rock or the like which is generally designated by the reference numeral P.

The building B of FIG. 1 is shown devoid of any insulation whatever, and under conventional practices, insulation might, of course, be provided in bat, roll or like form and normally is housed in the areas between the wall studs Ws, the ceiling joist Jc and the floor joist Jf. The present invention is designed to fully insulate the building B or a like building structure if the latter is without insulation or to augment existing insulation in a relatively easy and economical manner.

Figure 2:
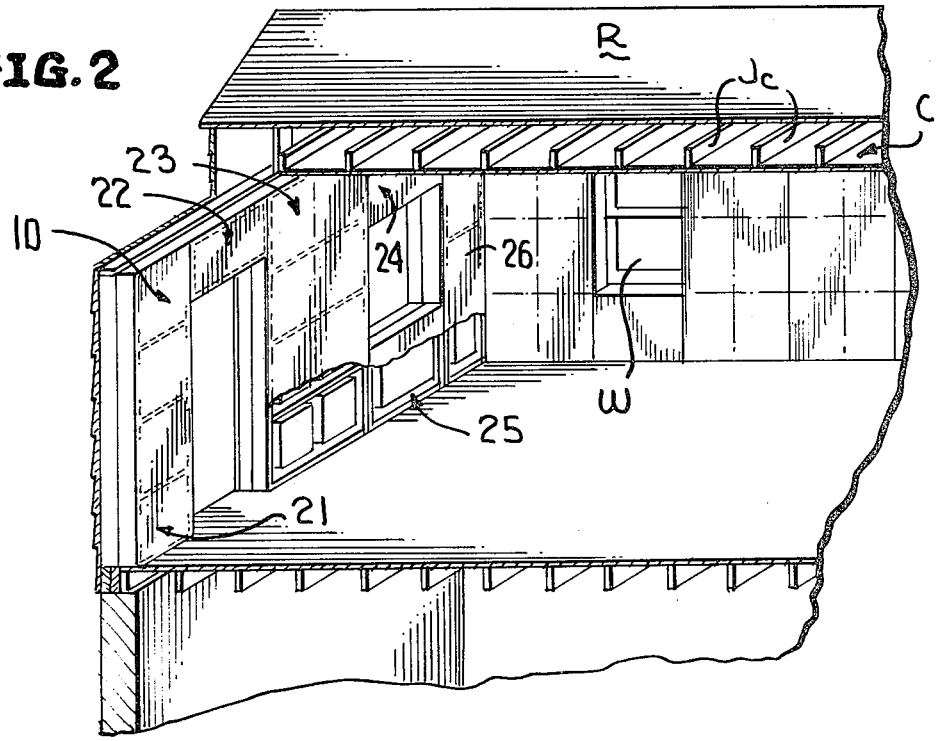
FIG. 2 is a fragmentary perspective view of the same building as shown in FIG. 1, and illustrates a plurality of prefabricated composite insulating panels constructed in accordance with this invention positioned internally and against the vertical walls of the building and in surrounding relationship to the window and door openings.

Reference is now made to FIG. 2 of the drawings which illustrates applicant's novel thermal insulating system which is generally designated by the reference numeral 10 and is shown installed in the building B along and against the two side walls S1 and S2. The thermal insulating system 10 includes a variety of different sized and shaped prefabricated insulating panels with there being six such panels 21 through 26 associated with the side wall S1, as is most readily apparent from FIG. 3 of the drawings. Similar groups of prefabricated insulating panels (unnumbered) are associated with the side wall S2 but are unnumbered and will not be described simply to simplify this disclosure.

Figure 3:
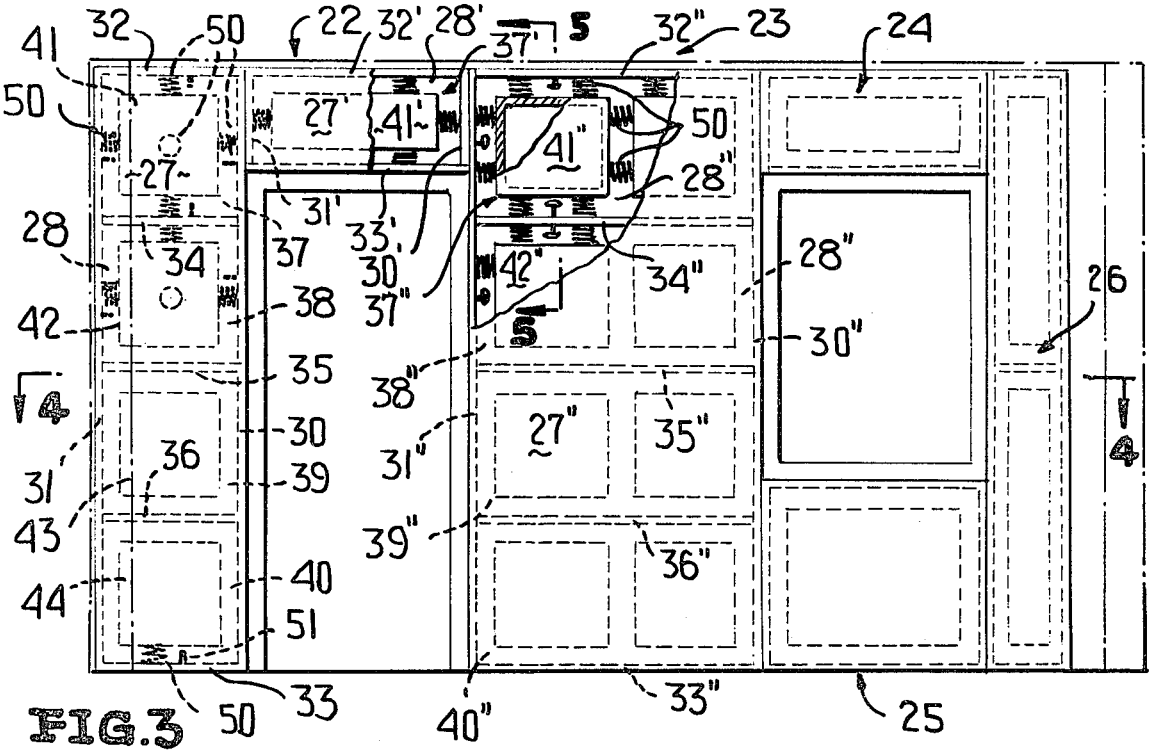
FIG. 3 is a front elevational view of a plurality of composite panels each housing one or more inner panels under negative (vacuum) pressure.
Figure 4:
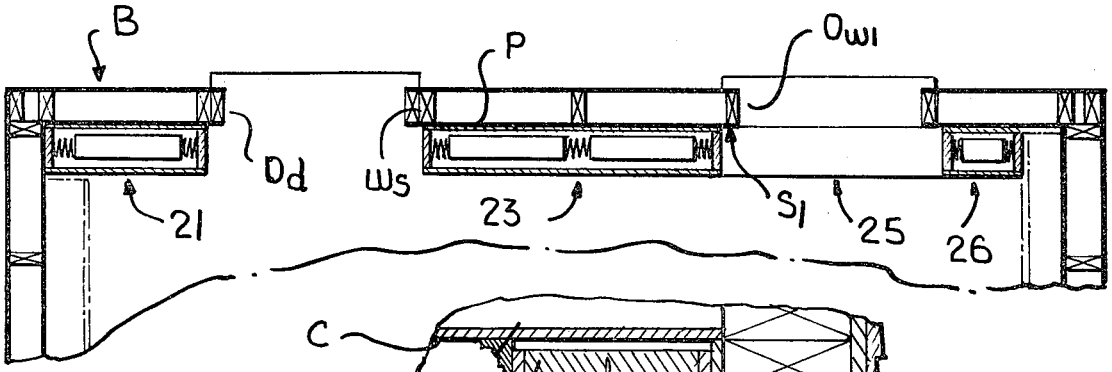
FIG. 4 is a fragmentary sectional view taken generally along line 4—4 of FIG. 3, and illustrates the manner in which three of the composite panels are disposed in noninterfering relationship to the existing door and window openings.
Figure 5:
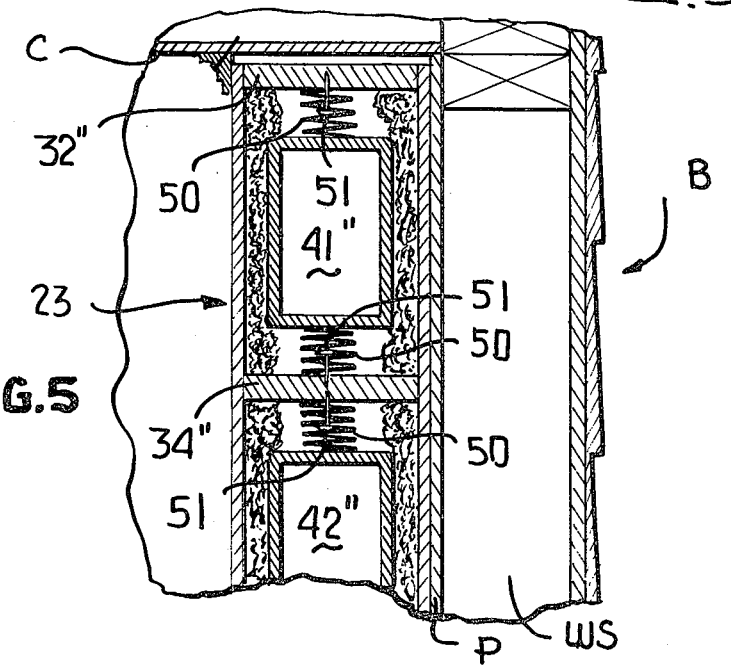
FIG. 5 is a fragmentary enlarged sectional view taken generally along line 5—5 of FIG. 3, and illustrates details of the interior of one of the composite insulating panels.

Referring specifically to FIG. 3 of the drawings, the prefabricated insulating panel 21 is a hollow generally rectangular of structure including a front rectangular panel 27, a rear rectangular panel 28, parallel sides 30, 31, parallel tops and bottoms 32, 33, and parallel partitions 34, 35 and 36. Thus, the overall prefabricated insulating panel 21 includes four separate hollow chambers 37 through 40 in each of which is a respective hollow rectangular container or insulating panel 41 through 44 under negative pressure (vacuum).

In order to support each of the hollow evacuated insulating panels or containers 41 through 44 in essentially total spaced relationship from the surrounding material of the panels 27, 28, the sides 30, 31, the top 32, the bottom 33 and/or the partitions 34 through 36, means generally designated by the reference numeral 50 in the form of coil springs are disposed between each of the walls (unnumbered) of the inner evacuating insulating panels or containers 41 through 44 and the associated surrounding material of the overall outer composite panel 21. The springs 50 thus maintain the evacuated insulating panels or containers 41 through 44 in generally spaced relationship within the chambers 37 through 40, respectively. Since there is very limited contact between the springs 50 and the evacuated panels 41 through 44, there is minimal thermal conduction or transfer between the overall composite panel 21 and the side wall S1, thus assuring the maximum insulating efficiency. Furthermore, though the springs are constructed of metal, they may be constructed from plastic or similar material which has extremely low thermal conductive characteristics (heat insulating and cold insulating), and such further increases or enhances the thermal insulating efficiency of the overall insulating panel 21.

Means generally designated by the reference numeral 51 are also associated with each of the inner hollow evacuated insulating panels or containers 41 through 44. The means 31 are a plurality of elongated pin-like elements of relatively small cross-sectional configuration which are, for example, simply nails driven into the sides 30, 31, the tops 32, 33, the partitions 34 through 36 and the panels 27, 28 with the exposed ends thereof being in opposed spaced relationship to the associated inner hollow evacuated insulating panels or containers 41 through 44. The purpose of the pin-like elements 31 is to contact a limited exterior surface area of any of the inner hollow evacuated panels 41 through 44 should the springs 50 associated therewith fail or otherwise become inoperative to maintain the panels 41 through 44 in spaced relationship within the associated compartments 37 through 40. For example, if the lowermost spring 50 supporting the inner evacuated container 44 fails, the container 44 might tend to drop, cock and in so doing contact over a larger surface area portions of the outer panel 21, but such is precluded by the bottom (unnumbered) of the lowermost container 44 coming to rest atop the lowermost pin 51 upon the breakage or inoperativeness of the spring 50 occurring.

It should be particularly noted that the perforated insulating panel 21 is of an overall height and width to accommodate or cover the entire portion of the wall S1 from ceiling C to floor F to the left of the door opening Od. Thus, the perforated insulating panel 21 can be preassembled, moved to the site of the building B, introduced through the door Od, and positioned as shown in FIGS. 2 and 3 and appropriately thereat nailed or otherwise secured in position.

The remaining perforated insulating panels 22 through 26 are constructed generally identical to the prefabricated insulating panel 21 and thus the same will not be described in detail, although like reference numerals have been applied thereto and have been primed for ready reference thereto.

For example, the prefabricated insulating panel 22 is set-off by sides 30', 31', a top 32', a bottom 33', front and back panels 27', 28', respectively, and collectively the latter define a compartment 37' in which is housed a single evacuated hollow container or panel 41' supported by the usual springs 50 and having associated therewith the pin-like elements 51. The overall size and shape of the prefabricated insulating panel 22 is such as to fit in the area between the ceiling C and the upper edge of the door opening Od and, of course, between the remaining adjacent prefabricated insulating panels 21 and 23.

The prefabricated insulating panel 23 is approximately the same height as the prefabricated insulating panel 21 but is approximately twice the width thereof and is defined by sides 30", 31", a top 32", a bottom 33", partitions 34" through 36", a front panel 27" and a back panel 28" collectively defining four compartments 37" through 40" within which are located the evacuated hollow containers or panels 41", 42", etc. The prefabricated insulating panel 23 is sized to fit between the ceiling C and the floor F and, of course, between the door opening Od and the window opening Ow1.

The perforated insulating panels 24, 25 are identical in construction to the prefabricated insulating panel 22 except, of course, the insulating panel 25 is slightly larger in a vertical direction than the panels 22, 24.

Finally, the prefabricated insulating panel 26 is of a height corresponding to that of the prefabricated insulating panel 21 but is but half the width thereof and includes internally two relatively long, though narrow, inner hollow evacuated insulating panels or containers 41''' and 42'''.

From the foregoing, it will be noted that irrespective of whether or not the building B has been constructed or is under construction, the prefabricated insulating panels 21 through 26 can be preformed at a factory, shipped to the site, and installed internally (or externally) to fully overly and thus insulate the entire side wall S1 of the building B. Obviously, depending upon the differences in sizes and shapes of the various remaining walls S2, the ceiling C, the floor F and the access openings Ow2 associated therewith, like prefabricated insulating panels can be constructed and assembled as is apparent from not only FIG. 2, but also FIGS. 6 and 7 in which similar prefabricated insulating panels to those described are shown installed in the attic above the ceiling C (FIG. 6) and in a basement B1 (FIG. 7).

Figure 6:
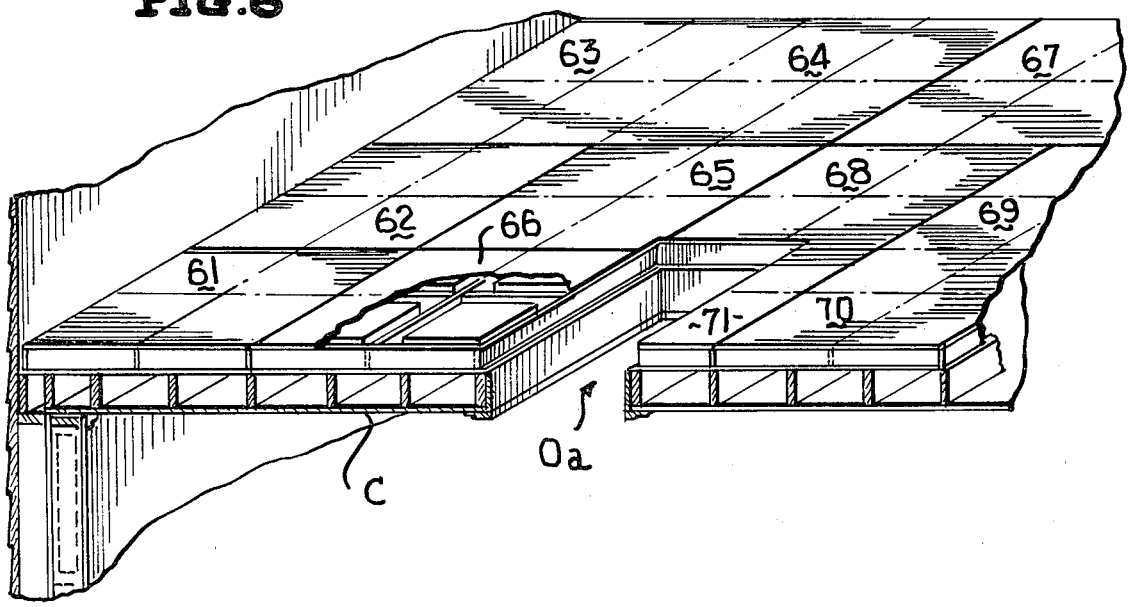
FIG. 6 is a perspective view of the ceiling/attic floor of the building of FIG. 1, and illustrates the same after a plurality of composite insulating panels have been positioned thereon.

Referring specifically to FIG. 6, the ceiling C is illustrated with an attic access opening Oa which can accommodate a stairwell, stairway, or a drop-down stairway. In order to insulate the attic, ten identical prefabricated insulating panels 61 through 70 are shown positioned atop the ceiling C within the attic with each of the perforated insulating panels 61 through 70 being of a square configuration defining four compartments with an inner hollow evacuated container or panel within each compartment. The size of the square panels 61 through 70 could vary, but they are preferably approximately four feet by four feet. Another prefabricated insulating panel 71 is approximately half the size of any one of the panels 61 through 70 and is positioned between the attic opening Oa and the insulating panel 70. Thus, all of the panels are aligned in identical size, except the panel 71 with the panels 66, 68 and 71 generally surrounding and conforming to the access opening Oa. In this way, the entire attic area above the ceiling C is insulated in a relatively easy and efficient manner with, of course, all of the panels 61 through 71 being of a size to fit through the opening Oa if, of course, the latter is the only access area into the attic. Preferably, the prefabricated insulating panels 61 through 71 are of a sturdier construction then the panels 21 through 26 as they must necessarily accommodate people walking thereupon or perhaps furniture being placed thereupon. Otherwise, the construction of the prefabricated insulating panels 61 through 71 are generally identical to that described most specifically relative to the prefabricated insulating panel 21.

Figure 7:
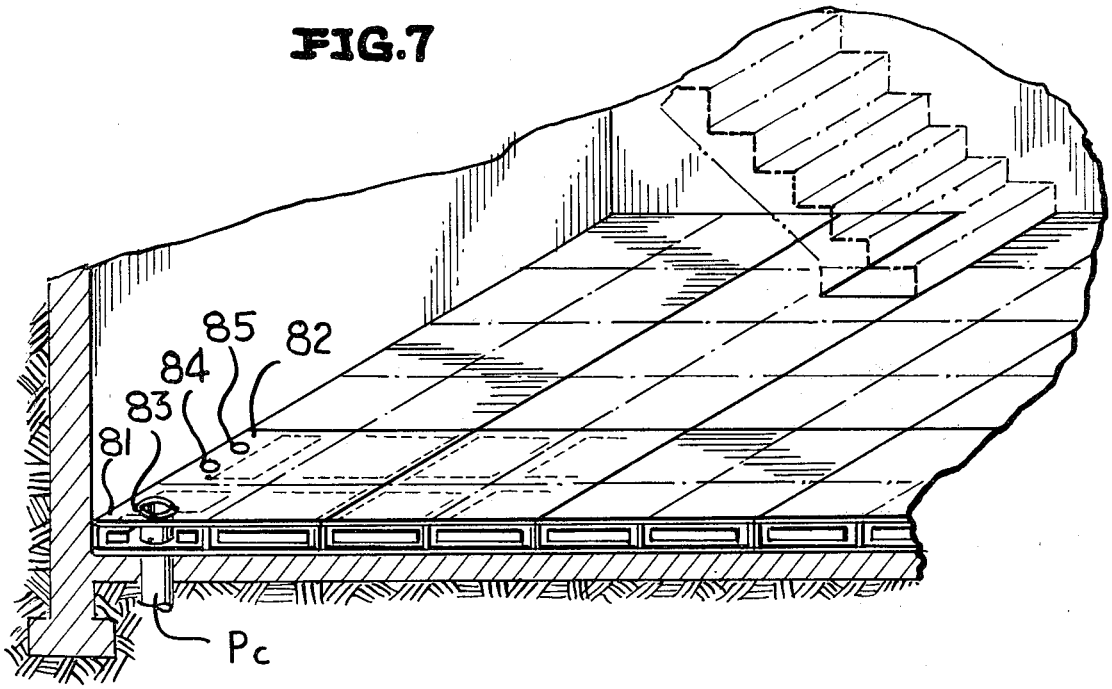
FIG. 7 is a fragmentary perspective view of a basement of the building of FIG. 1, and illustrates the manner in which some of the composite panels are provided with openings to accommodate pipes (water or drain) or like installed structures.

Reference is now made to FIG. 7 which illustrates a plurality of prefabricated insulating panels identical to those heretofore described relative to FIG. 6 except that two individual panels 81, 82 each of a generally square configuration are provided with openings 83 and 84, 85, respectively, completely therethrough while housing therein one or more evacuated hollow interior containers or panels (unnumbered). The purpose of the openings or access means 83 through 85 is to accommodate existing pipes or conduits Pd, such as water pipes, sewage drain pipes, electrical conduits, etc. Thus, if the pipe Pd was in existence, the insulating panel 81 could simply be prefabricated with the opening 83 therein and positioned as shown in FIG. 7 to fully insulate the area immediately adjacent the pipe Pd.

Variations in the disclosure will be apparent from this description and, of course, such variations are considered part hereof. For example, while the prefabricated insulating panels 21 through 26 are each of an individual construction, it might well be that all can be united into but a single composite panel as a single composite panel and applied in position against the side wall S1, if, of course, the building B is under construction and the entire one-piece composite panel can be so installed. Furthermore, instead of the panels 21 through 26 being individual panels or one entire composite panel, they may be united in a variety of different ways, as, for example, the panels 23 through 26 might be but a single one-piece composite panel, and variations are obviously apparent in keeping with this invention.

Although only a preferred embodiment of the invention has been specifically illustrated and described herein, it is to be understood that minor variations may be made in the apparatus without departing from the spirit and scope of the invention, as defined in the appended claims.

I claim:

1. A system for insulating building walls, ceilings, floors or like structure comprising wall means for forming a plurality of hollow insulating inner panels each defining an interior chamber under negative pressure, said panels each being of a predetermined external peripheral size and shape, means for forming an outer hollow panel of a predetermined internal peripheral size and shape sufficient to accommodate said plurality of inner panels in generally side-by-side relationship whereby said inner panels are housed in spaced relationship within said outer panel, means between said inner and outer panels for contacting a limited exterior surface area of said inner panels for supporting said inner panels in generally spaced relationship to said outer panels, means within said outer panel and normally spaced from the exterior surface of said inner panels for contacting a limited exterior surface area of said inner panels only upon said first-mentioned contacting means becoming inoperative which would in the absence of said second-mentioned contacting means result in direct contact between said inner and outer panels, said second-mentioned contacting means being an elongated pin-like element of relatively small cross-sectional configuration whereby thermal conduction transfer therethrough is substantially negligible, and said outer hollow panel including means for forming at least one access area through said outer hollow panel for mating with existing door, window and like openings in an associated building structure.

2. The insulating system as defined in claim 1 wherein said first-mentioned contacting means is a spring.

3. The insulating system as defined in claim 1 wherein said first-mentioned contacting means is a coil spring.

4. The insulating system as defined in claim 1 wherein said access area is an opening totally interiorly of and bounded by an external periphery of said outer panel.

5. The insulating system as defined in claim 1 wherein said access area is an opening bounded in part by and defined by an external periphery of said outer panel.

6. The insulating system as defined in claim 1 wherein said access area includes at least first and second openings, said first opening being totally interiorly of and bounded by an external periphery of said outer panel, and said second opening being bounded in part by and defined by said outer panel periphery.

7. The insulating system as defined in claim 1 wherein said access area is an opening in said outer panel, and said opening is bounded on each of at least three sides by one of said inner panels.

8. The insulating system as defined in claim 4 wherein said first-mentioned contacting means is a spring.

9. The insulating system as defined in claim 4 wherein said first-mentioned contacting means is a coil spring.

10. The insulating system as defined in claim 5 wherein said first-mentioned contacting means is a spring.

11. The insulating system as defined in claim 5 wherein said first-mentioned contacting means is a coil spring.

12. The insulating system as defined in claim 6 wherein said first-mentioned contacting means is a spring.

13. The insulating system as defined in claim 6 wherein said first-mentioned contacting means is a coil spring.

14. The insulating system as defined in claim 6 wherein said second-mentioned contacting means is an elongated pin-like element of relatively small cross-sectional configuration whereby thermal conduction transfer therethrough is substantially negligible.

15. A building structure comprising means for defining a plurality of load bearing walls, floors, ceiling and like building elements, means associated with at least selected ones of said building elements for defining at least one opening therein, said selected one building element being of a predetermined peripheral size and shape, said one opening being of a predetermined size and shape, means for forming an outer hollow panel of a size and shape corresponding to the predetermined size and shape of said selected one building element, means for forming an opening in said outer hollow panel corresponding generally in size and shape to said one opening, said outer hollow panel being disposed contiguous said selected one building element with the respective openings thereof being in general registry, a plurality of hollow insulating inner panels each defining an interior chamber under negative pressure, said inner panels being housed within said outer hollow panel, in generally side-by-side spaced relationship, means between said inner and outer panels for contacting a limited exterior surface area of said inner panels for supporting said inner panels in generally spaced relationship to said outer panel, means within said outer panel and normally spaced from the exterior surface of said inner panels for contacting a limited exterior surface area of said inner panels only upon said first-mentioned contacting means becoming inoperative, and said second-mentioned contacting means being an elongated pin-like element of relatively small cross-sectional configuration whereby thermal conduction transfer therethrough is substantially negligible.

16. The insulating system as defined in claim 15 wherein said first-mentioned contacting means is a spring.

17. The insulating system as defined in claim 15 wherein said first-mentioned contacting means is a coil spring.

* * * * *